US006139376A

United States Patent [19]

Ooya et al.

[11] Patent Number: 6,139,376

[45] Date of Patent: Oct. 31, 2000

[54] FEMALE ELECTRICAL TERMINAL

[75] Inventors: Masaaki Ooya, Yokohama; Masahiro Sakano, Ebina, both of Japan

[73] Assignee: Molex Incorporated, Lisle, Ill.

[21] Appl. No.: 09/073,418

[22] Filed: May 6, 1998

[30] Foreign Application Priority Data

May 9, 1997 [JP] Japan ..... 9-136125

[51] Int. Cl.[7] ..... H01R 13/187

[52] U.S. Cl. ..... 439/843; 439/948; 439/442

[58] Field of Search ..... 439/843, 842, 439/845, 846, 847, 852, 948, 442

[56] References Cited

U.S. PATENT DOCUMENTS

| | | | |
|---|---|---|---|
| 4,209,221 | 6/1980 | Chupak et al. | 439/948 |
| 5,147,230 | 9/1992 | Plyler et al. | 439/843 |
| 5,158,485 | 10/1992 | Saito et al. | 439/843 |
| 5,186,664 | 2/1993 | Abe | 439/845 |
| 5,226,842 | 7/1993 | Endo et al. | 439/843 |
| 5,271,741 | 12/1993 | Saito et al. | 439/843 |
| 5,433,629 | 7/1995 | Yagi et al. | 439/843 |
| 5,441,428 | 8/1995 | Hamai et al. | 439/843 |
| 5,462,459 | 10/1995 | Childs | 439/856 |
| 5,810,627 | 9/1998 | Gierut et al. | 439/843 |

FOREIGN PATENT DOCUMENTS

| | | |
|---|---|---|
| 62-13332 | 4/1987 | Japan . |
| 4-94275 | 8/1992 | Japan . |
| 5-4792 | 1/1993 | Japan . |
| 5-11666 | 3/1993 | Japan . |
| 914450 | 12/1994 | Japan . |
| 60-38840 | 9/1996 | Japan . |

*Primary Examiner*—Gary F. Paumen
*Assistant Examiner*—Tho D. Ta
*Attorney, Agent, or Firm*—A. A. Tirva

[57] ABSTRACT

A female electrical terminal has a contact end a terminating end. The contact end is generally rectangular in cross-section and includes a pair of opposing side walls extending upwardly from opposite sides of a bottom wall, along with a top wall. A deformable tab is provided in each side wall. A spring contact element is located in the contact end for biasingly engaging a male terminal inserted into the contact end. The spring contact element includes recess portions adapted to receive the deformable tabs of the side walls.

10 Claims, 2 Drawing Sheets

FEMALE ELECTRICAL TERMINAL

FIELD OF THE INVENTION

This invention generally relates to the art of electrical connectors and, particularly, to a female terminal for use in an electrical connection.

BACKGROUND OF THE INVENTION

Very generally, a typical electrical connector combination includes a plug connector and a receptacle connector, both of which mount or house interengageable electrical terminals. The plug connector is inserted into or mated with the receptacle connector to interengage the terminals. The terminals may take a variety of configurations, including male and female or pin and socket terminals.

A known type of female socket terminal is elongated and has a terminating end and a contact end. The terminating end may be adapted for termination to an electrical wire, for instance. The contact end is box-shaped or generally rectangular in cross-section for receiving a male or pin contact or terminal. The female socket terminal typically is stamped and formed from sheet metal material, and spring sections may be stamped therefrom for resiliently gripping the pin contact or terminal. On the other hand, separate spring contact elements have been used with such female socket terminals.

For example, in U.S. Pat. No. 5,441,428, dated Aug. 15, 1995, a female socket terminal employs a separate spring element to resiliently grip an inserted pin contact or terminal. In particular, the female socket terminal disclosed therein is generally rectangular in cross-section and includes a bottom plate portion having two sides. A pair of opposing side plate portions extend upwardly from both sides of the bottom plate portion. Two lug engagement holes are formed in the two side plate portions immediately adjacent the bottom plate portion. A pair of opposing top plate half portions extend inwardly from upper ends of the side plate portions. A spring element is mounted within the female terminal and includes a spring body and a pair of lug portions engaged within the lug engagement holes formed in the two side plates portions near the bottom plate portion. During assembly, the top plate half portions and the side plate portions are spread apart to allow insertion of the spring element transverse to the longitudinal direction of the terminal until the lug portions of the spring element engage within the lug engagement holes formed in the two side plate portions near the bottom wall.

Problems are encountered with female socket terminals as described above in relation to the U.S. Pat. No. 5,441,428. In particular, the spring element that grips the mating pin contact or terminal is mounted against the bottom plate portion of the female terminal and biases the male terminal upwardly against the top plate half portions which are joined at an open seam. This tends to open the seam and spread the opposing side plate portions of the female terminal which, in turn, reduces the contact forces on the mating male terminal. In addition, spreading and closing the female terminal tends to eventually loosen the intended interconnection. Lastly, assembling the spring element into the box-shaped female terminal transverse to the longitudinal direction of the terminal is a costly and cumbersome procedure.

An improved female electrical terminal for solving these problems is shown in copending application Ser. No. 08/565,750, filed Dec. 1, 1995 and assigned to the assignee of the present invention. With the structure of the female electrical terminal shown and described therein, the male terminal is biased against the solid bottom wall of the contact end rather than upwardly against the top half walls and the open seam. Therefore, there is no tendency to spread the contact end apart. In addition, the spring contact element may be more easily assembled into the contact end longitudinally of the terminal rather than transversely thereof. The terminal includes other improved features.

Another improved female electrical terminal which solves the above problems is shown in copending application Ser. No. 08/583,833, filed Jan. 11, 1996 and assigned to the assignee of the present invention. With the structure of the female electrical terminal disclosed and described therein, the spring contact element is again located in the contact end inside the top wall and adapted to bias the male terminal into engagement with the bottom wall. The spring contact element includes a generally rectangular mounting section with side wall portions juxtaposed inside the opposing side walls at the contact end of the female terminal. Complementary interengaging latch means are provided between the opposing side walls and the side wall portions of the mounting section of the spring contact element. Abutment means are provided on the bottom wall to prevent inward collapsing of the side wall portions and, thereby, to maintain the latch means in interengagement. This improved female terminal is more reliable, and provides greater stability for the spring contact element and is easier to manufacture than the prior art shown in U.S. Pat. No. 5,441,428.

One additional prior art problem i.e. deformation of electrical conductor crimping arms at different heights is solved by addition of notches on the inside surfaces of the crimping arms. The present invention again is directed to solving the above problems and providing a further improved box-type female socket terminal which is reliable and easy to manufacture.

SUMMARY OF THE INVENTION

An object, therefore, of the invention is to provide a new and improved female electrical terminal of the character described.

In the exemplary embodiment of the invention, the female electrical terminal is elongated and includes a contact end and a terminating end. The contact end is generally rectangular in cross-section and is adapted to receive a male terminal or pin contact. The contact end includes a bottom wall, a pair of opposing side walls extending upwardly from opposite sides of the bottom wall and a top wall. Each side wall is provided with a deformable tab. A spring contact element is located in the contact end for biasingly engaging a male terminal inserted into the contact end. The spring contact element is provided with recess portions adapted to receive the deformable tabs of the side walls. As disclosed herein, the female electrical terminal is stamped and formed of conductive sheet metal material. The deformable tabs in the side walls are stamped out of openings which span the junctures between the side walls and the bottom wall. Therefore, the spring contact element is located in the contact end to bias the male terminal toward the top wall. The top wall comprises a pair of overlapping top wall portions extending inwardly from the tops of the side walls to provide a rigid top wall means which is not prone to spreading apart.

Other features of the invention include stop means projecting inwardly from one of the walls to define a forward limit position of insertion of the male terminal. The spring contact element includes a cantilevered contact blade extending longitudinally of the terminal. The bottom wall includes a raised boss to provide an anti-overstress means for the cantilevered contact blade.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2:
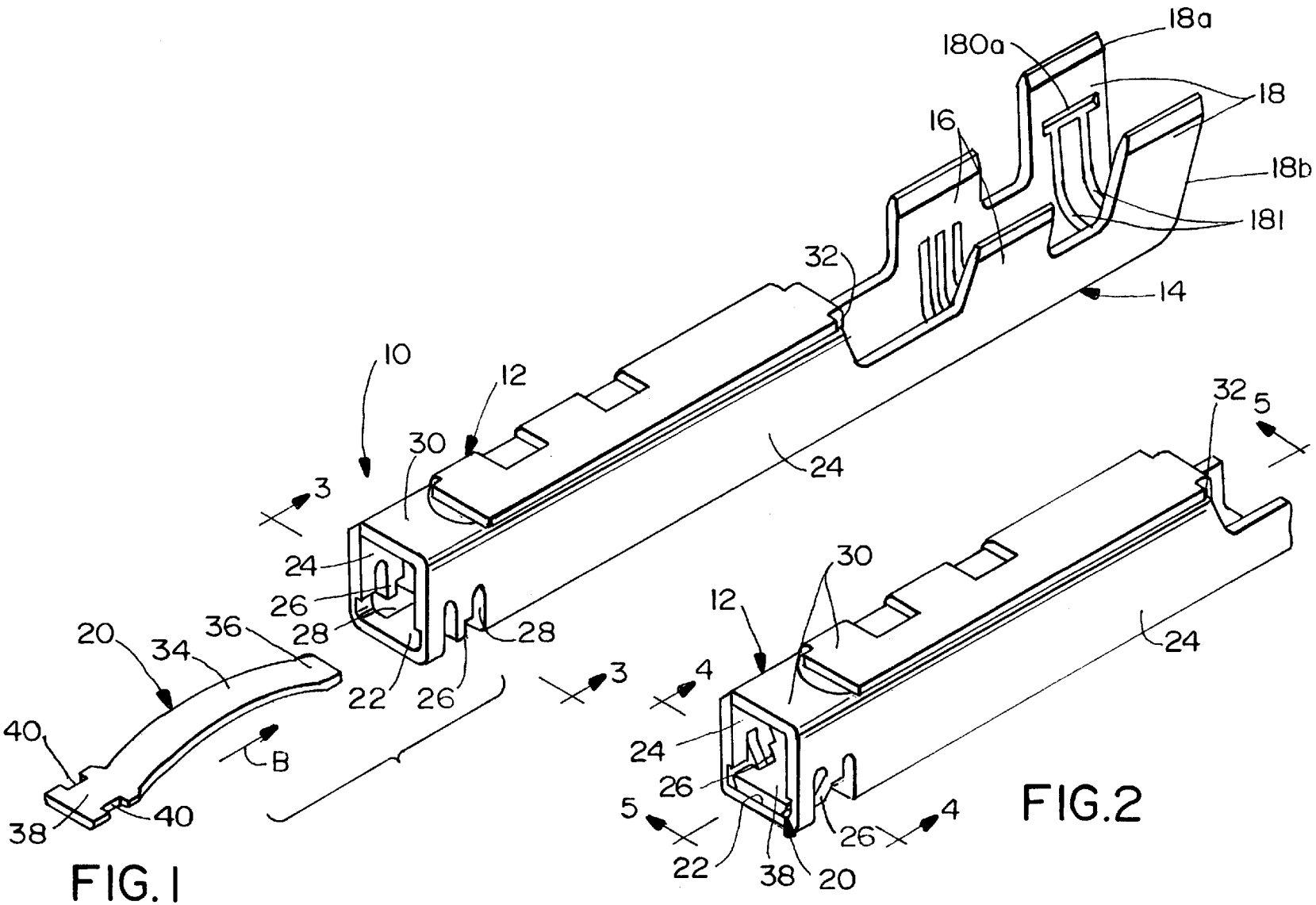
FIG. 1 is an exploded perspective view of the female electrical terminal of the invention, with the spring contact element about to be inserted into the contact end of the terminal.
FIG. 2 is a fragmented perspective view of the contact end of the terminal with the spring contact element fully inserted into its proper position.

Referring to the drawings in greater detail, and first to FIGS. 1 and 2, the invention is embodied in an elongated female electrical terminal, generally designated 10, which includes a contact end, generally designated 12, and a terminating end, generally designated 14. Terminating end 14 includes two pairs of crimp arms 16 and 18 for clamping onto an insulated electrical wire (not shown). As is known, a pair of conductor crimp arms 16 will be clamped onto the conductor of the wire to establish an electrical connection therewith and a pair of insulator crimp arms 18 will be clamped onto the outer insulation of the wire to provide a strain relief means therefor. Contact end 12 is generally box-shaped or rectangular in cross-section and mounts a spring contact element, generally designated 20, for resiliently gripping a pin contact or male terminal inserted into the contact end of the female electrical terminal in the direction of arrow "A" (FIG. 2). The spring contact element is inserted into contact end 12 in the direction of arrow "B" (FIG. 1).

More particularly, contact end 12 includes a bottom wall 22 and a pair of opposing side walls 24 extending upwardly from opposite sides of the bottom wall. A deformable tab 26 is formed out of an opening 28 in each side wall 24, with the opening spanning the juncture between the respective side wall and bottom wall 22. A pair of top wall portions 30 extend inwardly from upper ends of side walls 24 and overlap each other to provide a rigid and reinforced top wall means which is not prone to spreading apart. Lastly, a stop flange 32 is bent inwardly from the rear end of the uppermost one of the overlapped top wall portions 30 to provide a stop means which defines a forward limit position of insertion of the male terminal.

As best seen in FIG. 1, spring contact element 20 includes a cantilevered, upwardly or inwardly bowed contact blade 34 terminating in a flat distal end 36. A flat proximal end 38 has a recess 40 in each opposite edge thereof. The flat distal end 38 is wider than bowed contact blade 34.

Figure 3:
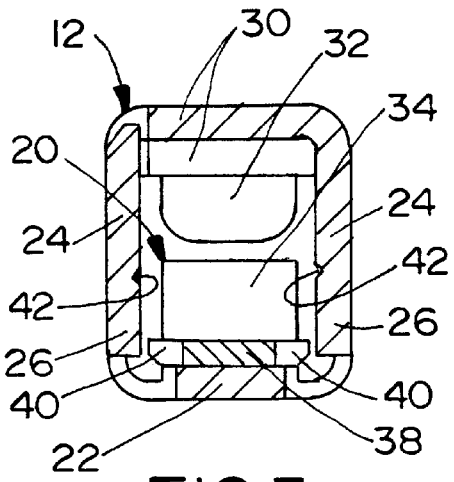
FIG. 3 is an enlarged vertical section taken generally along line 3—3 of FIG. 1, but with the spring contact element in position.
Figure 4:
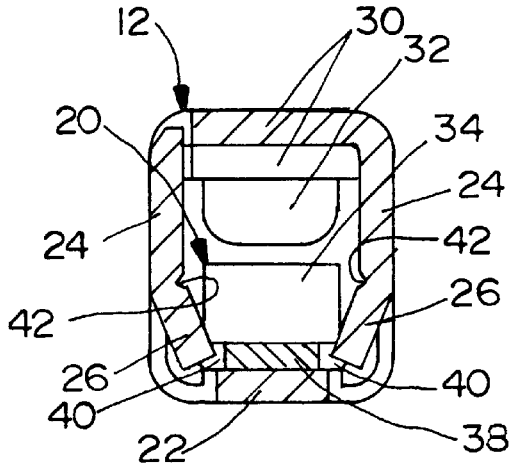
FIG. 4 is an enlarged vertical section taken generally along line 4—4 of FIG. 2.

Referring to FIGS. 3 and 4 in conjunction with FIGS. 1 and 2, spring contact element 20 is inserted into contact end 12 of female terminal 10 in the direction of arrow "B" as shown in FIG. 1, until recesses 40 of the spring contact element are in alignment with deformable tabs 26 in side walls 24 of contact end 12. After the spring contact element is inserted to this position, tabs 26 are deformed or bent inwardly from their original stamped positions as shown in FIGS. 1 and 3, to their latching positions as shown in FIGS. 2 and 4. In their latching positions, the tabs project inwardly into recesses 40 at opposite edges of flat proximal end 38 of spring contact element 20. The insides of side walls 24 can be notched, as at 42, to define the specific points at which deformable tabs 26 are bent inwardly.

Figure 5:
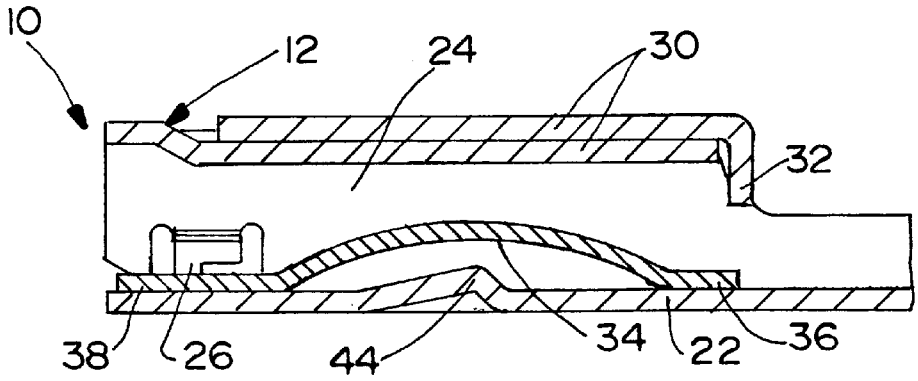
FIG. 5 is an axial section taken generally along line 5—5 of FIG. 2.

FIG. 5 shows how stop flange 32 projects inwardly from the uppermost one of the overlapped top wall portions 30 to define the extreme forward limit position of insertion of the male terminal. It can be seen how contact blade 34 bows upwardly of bottom wall 22 of the contact end. FIG. 5 shows an anti-overstress feature of the invention which includes a raised boss 44 formed upwardly or inwardly of bottom wall 22 directly under the bowed contact blade 34.

Figure 6:
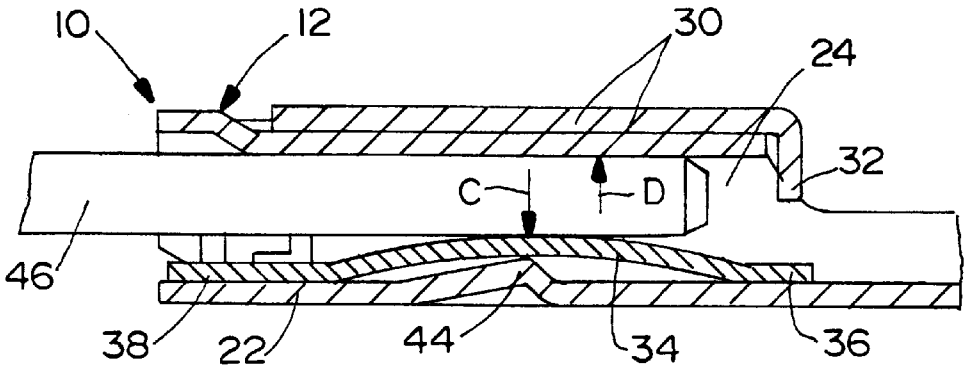
FIG. 6 is an axial section similar to that of FIG. 5, but with a male terminal inserted into the female terminal.

FIG. 6 shows a male terminal or pin 46 inserted into contact end 12 of female terminal 10. Although the male terminal has not been inserted to an extent wherein its distal end engages stop flange 32, the stop flange still extends into the path of the male terminal to define the forward limit position beyond which the male terminal cannot be inserted. FIG. 6 also shows how the male terminal has depressed bowed contact blade 34 downwardly in the direction of arrow "C". Although the contact blade is not in engagement with raised boss 44, the raised boss still functions to prevent excessive depressing of the contact blade which might overstress the blade. In essence, the bowed contact blade biases male terminal 46 upwardly in the direction of arrow "D" against the rigid and reinforced upper wall means provided by the overlapped top wall portions 30 which define a solid double-thickness structure against which the male terminal is biased.

FIG. 1 shows insulator crimp arms 18 consist of a pair of insulator crimp arms 18*a*, 18*b*. A lateral notch 180*a* approximately parallel to the elongated direction of female terminal 10 is formed on the inside surface of insulator crimp arm 18*a*. And a lateral notch 180*b* (not shown) approximately parallel to the elongated direction of female terminal 10 is formed on the inside surface of crimp arms 18*b*. Notches 180*a*, 180*b* are formed in a portion of each crimp arms 18*a*, 18*b* which approximately equally distant from bottom wall 22. Sections of notch 180*a*, 180*b* are preferably V-shaped. Notches 180*a*, 180*b* are defines the specific point at which insulator crimp arms 18*a*, 18*b* are deformed or bent inwardly. Furthermore, one or more serrations 181 may be formed between notch 180*a* and notch 180*b*. Serrations 181 preferably extend approximately right angle direction of notches 180*a* and 180*b*, respectively.

Finally, it should be understood that terms as "top", "bottom", "upper", "lower" and the like are used herein and in the claims hereof for reference purposes only to provide a clear and concise understanding of the invention. Such terms are not meant in any way to be limited herein or in the claims hereof, because female electrical terminal 10 obviously is omnidirectional in function and use.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In an elongated female electrical terminal which includes a contact end and a terminating end, the contact end being generally rectangular in cross-section and comprising:

a bottom wall;

a pair of opposing side walls extending upwardly from opposite sides of the bottom wall, and a deformable tab in each side wall;

a top wall;

a spring contact element located in the contact end for biasingly engaging a male terminal inserted into the contact end, with recess portions of the spring contact element adapted to receive the deformable tabs of the side walls; and wherein said female electrical terminal is stamped and formed of conductive sheet metal material, and said deformable tabs are stamped out of openings in the material of the side walls and said openings span the junctures between the side walls and the bottom wall.

2. In an elongated female electrical terminal as set forth in claim 1, wherein said spring contact element is located at a position in the contact end to bias the male terminal toward the top wall.

3. In an elongated female electrical terminal as set forth in claim 1, wherein said top wall comprises a pair of overlapping top wall portions extending inwardly from the tops of the side walls.

4. In an elongated female electrical terminal as set forth in claim 1, including stop means projecting inwardly from one of said walls to define a forward limit position of insertion of the male terminal.

5. In an elongated female electrical terminal as set forth in claim 1, wherein said spring contact element includes a cantilevered contact blade extending longitudinally of the terminal.

6. In an elongated female electrical terminal as set forth in claim 1, wherein said bottom wall includes a raised boss to provide anti-overstress means for the spring contact element.

7. In an elongated female electrical terminal as set forth in claim 1, wherein said deformable tabs are located in the side walls near the bottom wall.

8. In an elongated female electrical terminal as set forth in claim 7, wherein said spring contact element is located at a position in the contact end to bias the male terminal toward the top wall.

9. In an elongated female electrical terminal as set forth in claim 1, wherein said terminal further includes a pair of crimp arms for clamping onto the conductive portion of an electrical wire, and a pair of crimp arms for clamping onto the insulation portion of the wire.

10. In an elongated female electrical terminal as set forth in clam 9, Wherein each of said insulator crimp arms has a lateral notch on the inside surface of the crimp arms which notches are substantially parallel to the elongated direction of the female terminal and substantially equally distant from said bottom wall.

* * * * *